US011566571B2

(12) United States Patent
Eloy et al.

(10) Patent No.: US 11,566,571 B2
(45) Date of Patent: Jan. 31, 2023

(54) ENGINE CONTROL METHOD FOR PROTECTING AN INTERNAL COMBUSTION ENGINE DURING REVERSE ROTATION

(71) Applicant: Vitesco Technologies GmbH, Regensburg (DE)

(72) Inventors: Stéphane Eloy, Toulouse (FR); Jérémie Memain, Toulouse (FR)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 17/616,840

(22) PCT Filed: Jun. 11, 2020

(86) PCT No.: PCT/EP2020/066175
§ 371 (c)(1),
(2) Date: Dec. 6, 2021

(87) PCT Pub. No.: WO2021/001131
PCT Pub. Date: Jan. 7, 2021

(65) Prior Publication Data

US 2022/0268225 A1 Aug. 25, 2022

(30) Foreign Application Priority Data

Jul. 1, 2019 (FR) ..... 1907256

(51) Int. Cl.
*F02D 41/00* (2006.01)
*F02D 41/04* (2006.01)
*F02D 41/22* (2006.01)

(52) U.S. Cl.
CPC ..... *F02D 41/0087* (2013.01); *F02D 41/009* (2013.01); *F02D 41/0097* (2013.01);
(Continued)

(58) Field of Classification Search
CPC ..... F02D 41/0087; F02D 41/0097; F02D 41/042; F02D 41/22; F02D 41/009;
(Continued)

(56) References Cited

U.S. PATENT DOCUMENTS 9,988,040 B2 * 6/2018 Verdier ..... B60W 50/0097
10,041,966 B2 8/2018 Marconato
(Continued)

FOREIGN PATENT DOCUMENTS

| | | | |
|---|---|---|---|
| DE | 10324858 | A1 | 1/2004 |
| EP | 2151562 | A2 | 2/2010 |
| FR | 2995939 | A1 | 3/2014 |
| WO | 2014044353 | A1 | 3/2014 |
| WO | 2015062725 | A1 | 5/2015 |

OTHER PUBLICATIONS

International Search Report and Written Opinion for International Application No. PCT/EP2020/066175, dated Aug. 21, 2020, with partial translation, 7 pages.
(Continued)

*Primary Examiner* — George C Jin
(74) *Attorney, Agent, or Firm* — RatnerPrestia

(57) ABSTRACT

Engine control method for protecting the engine during reverse rotation, and involving the following steps: when a first prediction of the engine speed at a next top dead center is below a predetermined lower threshold, inhibiting the next combustion for this cylinder of the engine, and when the first prediction of the engine speed is between the predetermined lower threshold and a predetermined upper threshold, and the engine reaches a second measurement predetermined angular position which is subsequent to the first measurement position, activating the prediction means again in order to obtain a second prediction of the engine speed at the next top dead center.

12 Claims, 3 Drawing Sheets

(52) U.S. Cl.
CPC ..... *F02D 41/042* (2013.01); *F02D 41/22* (2013.01); *F02D 2041/0092* (2013.01); *F02D 2200/101* (2013.01); *F02D 2250/06* (2013.01); *F02D 2250/12* (2013.01)

(58) Field of Classification Search
CPC ..... F02D 2200/101; F02D 2041/0092; F02D 2250/06; F02D 2250/12
See application file for complete search history.

(56) References Cited

U.S. PATENT DOCUMENTS

| | | | | |
|---|---|---|---|---|
| 2004/0149251 | A1 | 8/2004 | Nishikawa et al. | |
| 2014/0107903 | A1* | 4/2014 | Kawazu | F02D 31/001 701/101 |
| 2015/0260748 | A1* | 9/2015 | Marconato | F02D 41/0097 702/145 |
| 2016/0305355 | A1* | 10/2016 | Takizawa | F02N 11/0851 |
| 2017/0210385 | A1* | 7/2017 | Boemcke | F02D 41/0205 |

OTHER PUBLICATIONS

International Search Report and Written Opinion for International Application No. PCT/EP2020/066175, dated Aug. 21, 2020, 13 pages (French).
English Translation of the Written Opinion for International Application No. PCT/EP2020/066175, dated Aug. 21, 2020, 5 pages.

* cited by examiner

ENGINE CONTROL METHOD FOR PROTECTING AN INTERNAL COMBUSTION ENGINE DURING REVERSE ROTATION

CROSS REFERENCE TO RELATED APPLICATIONS

This application is the U.S. National Phase Application of PCT International Application No. PCT/EP2020/066175, filed Jun. 11, 2020, which claims priority to French Patent Application No. 1907256, filed Jul. 1, 2019, the contents of such applications being incorporated by reference herein.

FIELD OF THE INVENTION

The invention relates to the field of internal combustion engines and is aimed at an engine control method which protects the engine when the latter, under particular circumstances, experiences a temporary reversal of its direction of rotation.

BACKGROUND OF THE INVENTION

The internal combustion engines commonly used, notably in automobiles, are designed to rotate in a single direction of rotation. However, there are isolated risks of the direction of rotation of the engine being reversed in certain situations, and notably as the engine stops, whether this be a normal stop commanded by the driver, or an accidental stop resulting from the stalling of the engine.

Instances in which a combustion operation takes place in a cylinder of the engine when this engine has just experienced a reversal of its direction of rotation constitute a critical case which may damage the engine. This is because such combustion will accentuate the rotation in the reverse direction and, in addition, if the engine is fitted with a dual mass flywheel, this critical case may lead to damage or even destruction of the dual mass flywheel.

Because significant damage may be caused during a reversal of the direction of rotation of an internal combustion engine, there are solutions in existence for protecting the engine in such circumstances.

Patent application FR2995939, incorporated herein by reference, describes a method for estimating the speed of an engine in a predetermined position, which can be used with a view to determining, in advance, a risk of reversal of the direction of rotation of the engine. The estimated speed of the engine, for example at the next top dead center for a cylinder, is compared against a predetermined threshold. If the estimate is below this predetermined threshold, the step of triggering combustion at the top dead center concerned is inhibited.

The methods of the prior art succeed in protecting the engine in a great many cases, but their reliability is dependent on the choice of the predetermined threshold. If the predetermined threshold is set at a value that is not very high, there are a certain number of rotation-reversal situations that will not be detected, notably the most critical situations relating to a sharp and late variation in engine speed. Conversely, if the predetermined threshold is set at a high value, the number of false detections will be great, which is to say that multiple situations will be identified as involving a risk of reversal of the direction of rotation of the engine, even though this reversal of the direction of rotation does not actually occur, this leading to multiple and undesirable instances of combustion being inhibited. The setting of the predetermined threshold is therefore a compromise between the effectiveness with which a potential reversal of the direction of rotation of the engine can be detected, and the effectiveness of the propulsion afforded by the engine.

SUMMARY OF THE INVENTION

An aspect of the invention aims to improve the engine control methods of the prior art in order to protect an internal combustion engine from the consequences of a reversal of its direction of rotation.

To this end, an aspect of the invention is aimed at an engine control method for protecting an internal combustion engine during reverse rotation, the internal combustion engine comprising:

means for determining the angular position of the engine, this angular position being defined as being the angular position of the crankshaft of the engine;

means for predicting, at a first angular position of the engine, the engine speed for a future second angular position of the engine;

this method involving, for each cylinder of the engine, the following steps:

when the engine reaches a first measurement predetermined angular position, activating the prediction means to obtain a first prediction of the engine speed at the next top dead center;

when the first prediction of the engine speed is above a predetermined upper threshold, executing the next combustion for this cylinder of the engine;

when the first prediction of the engine speed is below a predetermined lower threshold, inhibiting the next combustion for this cylinder of the engine;

when the first prediction of the engine speed is between the predetermined lower threshold and the predetermined upper threshold, and the engine reaches a second measurement predetermined angular position which is subsequent to the first measurement predetermined angular position, activating the prediction means again in order to obtain a second prediction of the engine speed at said next top dead center. The result of this second prediction is then compared against predetermined thresholds in order to determine whether or not to inhibit the forthcoming combustion.

An aspect of the invention guarantees a high level of reliability in detecting a situation in which the direction of rotation is reversed, while at the same time avoiding superfluously inhibiting combustion, which is to say inhibiting when a reversal of the direction of rotation of the engine has not occurred. An aspect of the invention makes it possible to ensure that combustion will be inhibited only in the event of proven reversal of the direction of rotation The predetermined lower threshold may be set at a low value, a value situated for example between 150 rpm and 250 rpm and preferably 200 rpm, which corresponds to a speed below which it has been proven that a reversal of the direction of rotation of the engine will occur before the top dead center concerned. Likewise, the predetermined upper threshold may be set at a high value, a value situated for example between 350 rpm and 450 rpm and preferably 400 rpm, which corresponds to an engine speed for which it is certain that a reversal of the direction of rotation cannot occur before the top dead center concerned. Between these two thresholds, there is an area of uncertainty for which a second prediction of the engine speed is made, this second prediction being made at a second measurement predetermined angular position which is subsequent to the first measurement predetermined angular position. The second prediction is made subsequently to the first prediction, namely at a moment closer to the top dead center concerned, and is therefore more reliable than the first prediction. However, this second prediction leaves less time in which to inhibit the combustion. It will therefore preferably be carried out soon after the first.

When this method is implemented by a computer in an engine control unit, computation resources are optimized because the second prediction of the engine speed is performed only for instances in which the first prediction of the engine speed lies in the area of uncertainty, these instances representing a low percentage in the overall operation of the engine. The vast majority of cases are settled right from the first prediction of the engine speed.

The high level of protection of the engine is thus obtained with a computational-resources requirement that is similar to that of the prior art.

The method may comprise the following additional features, alone or in combination:

- the method involves the following additional step: when a prediction of the engine speed is between the predetermined lower threshold and the predetermined upper threshold, and the engine reaches a measurement predetermined angular position which is subsequent to the second measurement predetermined angular position, activating the prediction means in order to obtain an additional prediction of the engine speed at said next top dead center;
- the predetermined lower threshold has a value comprised between 150 and 250 rpm;
- the predetermined upper threshold has a value comprised between 350 and 450 rpm;
- the first measurement predetermined angular position has a value comprised between 18° and 30° before top dead center, and is preferably 24° before top dead center;
- the second measurement predetermined angular position has a value comprised between 12° and 24° before top dead center and is preferably 18° before top dead center;
- the internal combustion engine comprises a flywheel equipped with a circumferential toothset, and the means for determining the angular position of the engine comprise a sensor facing the circumferential toothset, and the method has a step of detecting the first measurement predetermined angular position that is performed by detecting a first predetermined tooth of the flywheel;
- the second measurement predetermined angular position corresponds to an angular position in which the sensor detects a second predetermined tooth of the flywheel, this second predetermined tooth immediately following the first predetermined tooth;
- the operation of inhibiting the next combustion for this cylinder of the engine consists in inhibiting the next injection of fuel and/or the next ignition operation for this cylinder of the engine;
- the activation of the prediction means in order to obtain a first prediction of the engine speed at the next top dead center, and the further activation of the prediction means to obtain a second prediction of the engine speed at said next top dead center, involve the following steps: initializing an angular-position variable for triggering prediction at the first measurement predetermined angular position; if a prediction of the engine speed is comprised between the predetermined lower threshold and the predetermined upper threshold, updating the angular-position variable for triggering prediction to a value corresponding to an angular position subsequent to the first measurement predetermined angular position;
- the method further involves the following step: making a prediction of the engine speed at said next top dead center when the angular position of the engine corresponds to the angular-position variable for triggering prediction.

An aspect of the present invention also relates to an engine control unit connected to a sensor for determining the angular position of the engine and comprising means for inhibiting or executing combustion in a cylinder of the engine by exercising control over the injection of fuel and/or ignition by a spark plug, characterized in that it comprises means for implementing each of the steps of a method as described hereinabove. These means adopt the form of software for executing said steps of the method according to an aspect of the invention implemented in the engine control unit.

BRIEF DESCRIPTION OF THE DRAWINGS

Further features and advantages of aspects of the invention will become apparent from the description thereof that is given hereinafter by way of non-limiting example, with reference to the accompanying drawings, in which.

DESCRIPTION OF THE EMBODIMENTS

Figure 1:
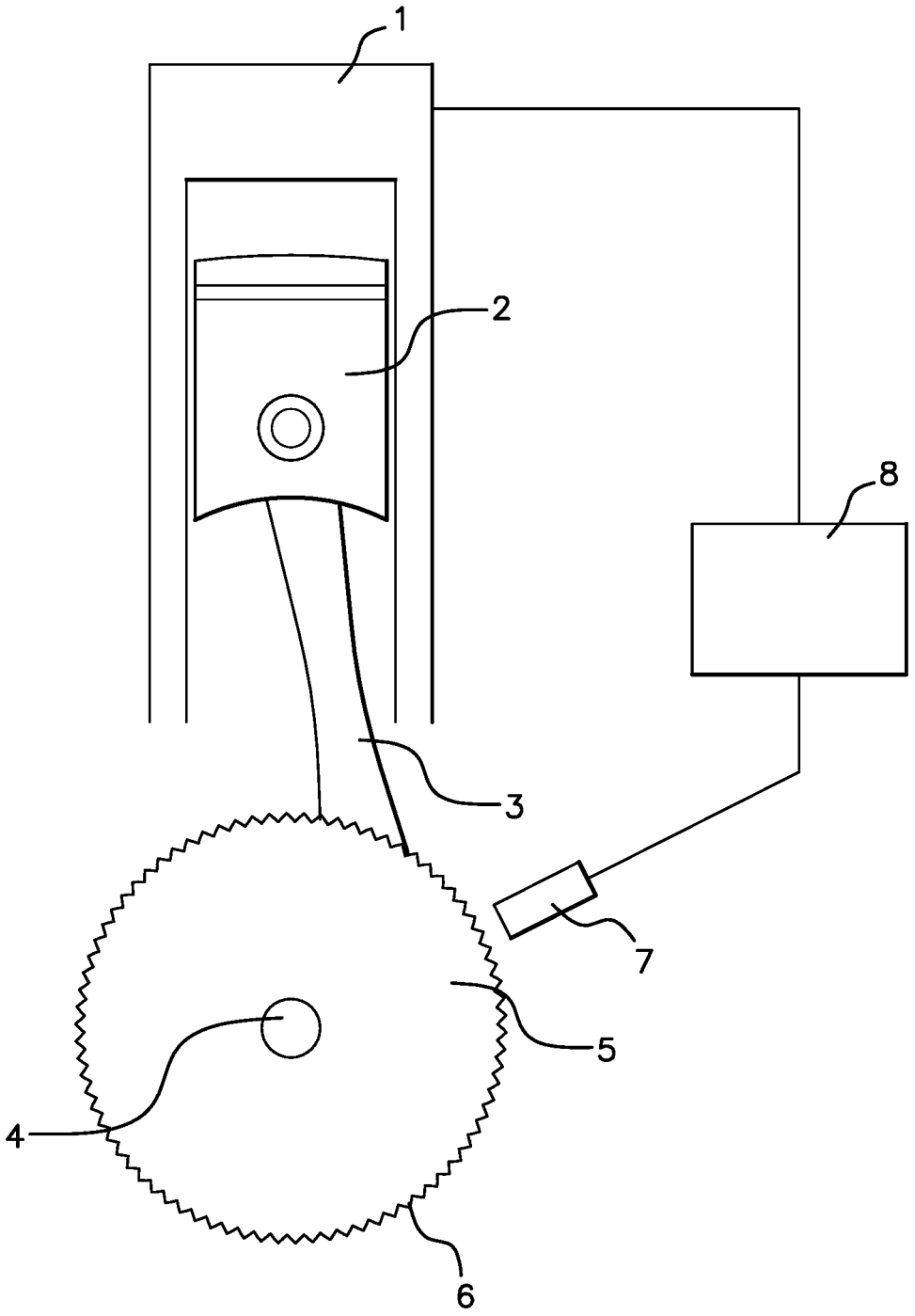
FIG. 1 schematically illustrates an internal combustion engine suitable for implementing the method according to an aspect of the invention.

FIG. 1 is a schematic depiction of an internal combustion engine. This figure depicts the following elements of one cylinder of the engine: the cylinder 1, the piston 2, the connecting rod 3 and the crankshaft 4 which is associated with a flywheel 5.

In the present example, the flywheel 5, which acts as an inertial mass, is a dual mass flywheel made up of two coaxial inertial elements connected by elastic means. The flywheel 5 comprises a circumferential toothset 6 which for example allows the flywheel 5 to be driven by an electric starter.

The engine additionally comprises means for determining the angular position thereof. The angular position of the engine is defined here as being the angular position of the crankshaft 4 and therefore also the angular position of the flywheel 5, or at least the angular position of those parts of the flywheel 5 that are fixed with respect to the crankshaft, and which include the circumferential toothset 6. In the present example, the means for determining the angular position of the engine comprise a sensor 7 suitable for measuring, for a given angular position of the engine, the angular sector through which the flywheel 5 needs to travel between this given angular position and a reference angular position, such as the angular position corresponding to the next top dead center. More specifically here, the sensor 7 detects the presence or absence of a tooth of the toothset 6. The angular position of the engine for a given cylinder is expressed here as an angle before the next top dead center, or as an angle after the last top dead center.

The engine additionally comprises an engine control unit 8 connected to the sensor 7 to determine the angular position of the engine and the functions of which are notably to trigger combustion in the cylinder 1 by exercising control over the injection of fuel and/or ignition by a spark plug.

The engine control unit 8 additionally comprises means for predicting, at a first angular position of the engine, the engine speed for a future second angular position of the engine. These prediction means allow an estimate to be made of the engine speed that will occur a few degrees or a few tens of degrees after the first angular position. These prediction means are generally used to predict an angular position in which the engine will stop or to detect a potential change in the direction of rotation of the engine. These prediction means may for example be those described in document FR2995939.

Figure 2:
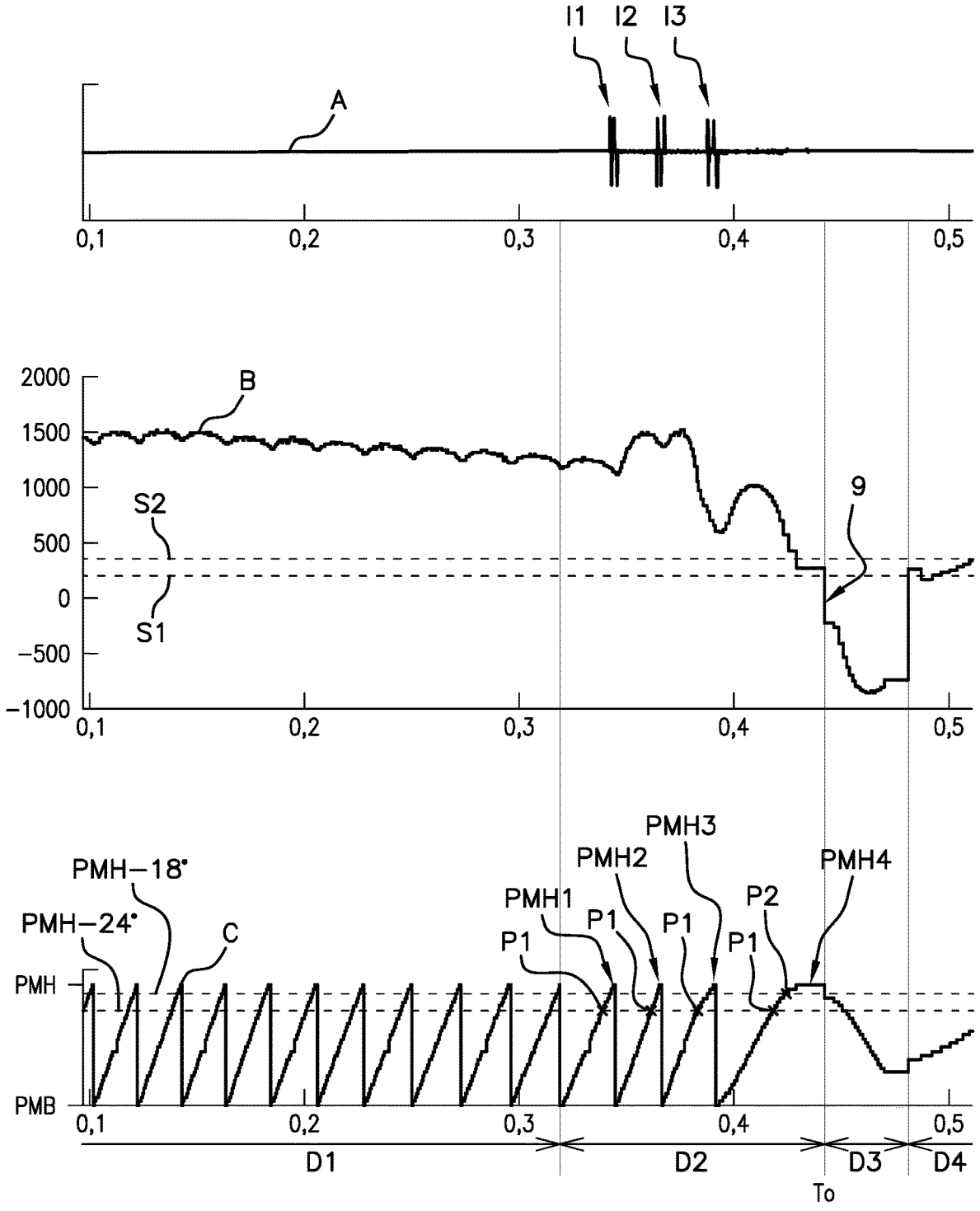
FIG. 2 is a graph illustrating the implementation of the engine control method according to an aspect of the invention in a situation in which a reversal of the direction of rotation of the engine occurs.

FIG. 2 is a graph illustrating the operation of one cylinder of the engine of FIG. 1 and the implementation of an engine control method according to an aspect of the invention, allowing the internal combustion engine to be protected in a reversal of the direction of rotation of the engine, for an automotive vehicle that is driving along.

In FIG. 2, three simultaneous curves A, B, C illustrate engine activity as a function of time expressed in seconds, over a timespan of around 0.5 second.

Curve A represents the operations of triggering combustion in the cylinder. In this example, the engine is a diesel engine and the operations of triggering combustion correspond to operations of injecting fuel. In this example, three injection operations I1, I2 and I3 represent three operations of triggering combustion.

Curve B represents the changes in engine speed as a function of time. On this curve B, a negative engine-speed value corresponds to a reversal of the direction of rotation of the engine.

Curve C illustrates the variation in angular position of the engine between top dead center (TDC) and bottom dead center (BDC).

In order to determine whether there is a risk of the engine reversing its direction of rotation, two thresholds S1 and S2 are provided to evaluate the predicted engine speed at top dead center (see curve B): a predetermined lower threshold S1 and a predetermined upper threshold S2.

The predetermined lower threshold S1 corresponds to a set value which is chosen as being the engine speed below which it is certain that a reversal of the direction of rotation will occur. This threshold may be set for example at 200 rpm. According to an aspect of the invention, this threshold needs to be set at a low value for which it is certain that, when the first prediction of the engine speed is below this value, a change in the direction of rotation of the engine at the next top dead center is certain to occur.

The predetermined upper threshold S2 is the threshold above which the predicted engine speed at the next top dead center reveals a certainty that the engine will not experience a reversal of its direction of rotation. In the present example, this predetermined upper threshold is set at 400 rpm. According to an aspect of the invention, this threshold needs to be set at a high value for which it is certain that, when the first prediction of the engine speed exceeds this value, a change in the direction of rotation of the engine at the next top dead center is impossible.

When a prediction of the engine speed at the next top dead center is below the predetermined lower threshold S1, the engine control unit 8 acts by inhibiting combustion at the top dead center concerned, in order to avoid any damage to the engine. When the prediction of the engine speed at top dead center is above the predetermined upper threshold S2, the certainty that a change in the direction of rotation of the engine will not occur means that normal engine operation can be maintained and combustion can therefore be performed at the top dead center concerned.

The thresholds S1 and S2 additionally define an area of uncertainty between them. The existence of this area of uncertainty allows conservative values to be selected for each of the thresholds S1 and S2. Specifically, a low value can be selected for the threshold S1 without having to worry about predictions that might be higher than the threshold S1 but nevertheless lead to a reversal of the direction of rotation of the engine. Likewise, a high value can be selected for the threshold S2 without having to worry about predictions that might be lower than the threshold S2 but nevertheless do not lead to a reversal of the direction of rotation of the engine.

For each first prediction of engine speed at top dead center, when the value of the prediction falls within the area of uncertainty, namely between the thresholds S1, S2, that means that this prediction value is unable to settle the matter of determining whether it will, or will not, definitely lead to a reversal of the direction of rotation of the engine. In that case, at least a second, additional, prediction is then made subsequently, namely as close as possible to the top dead center concerned. The closer to top dead center a prediction is made, the more closely this prediction reflects reality. The matter of determining whether there is a possibility of the direction of rotation being reversed, and therefore of whether combustion at top dead center will be inhibited or, on the other hand, maintained, will not be settled until one of these additional predictions leads to a predicted engine speed value that is above the predetermined upper threshold S2 or below the predetermined lower threshold S1. Optionally, the additional prediction or predictions may be compared against lower and upper thresholds which may be chosen to be different than the threshold S1 and S2, depending on the engine dynamics.

FIG. 2 illustrates an example of a critical situation in which a reversal of the direction of rotation of the engine occurs at the time TO. In this example, over a first timespan D1, the automobile is in an engine-braking phase, the engine speed decreasing slowly with the speed of the vehicle. A second timespan D2 follows on from the timespan D1 and corresponds to a timespan in which the engine is incapable of providing the necessary torque, for example because too high a gear ratio has been engaged. The timespan D2 culminates in the event TO in which the engine stalls and its direction of rotation is reversed. The engine temporarily turns over in the opposite direction and during the course of the timespan D3 (the dual mass flywheel 5 allows the engine to rotate temporarily in the opposite direction while the engine is engaged). The engine then reverts to its normal direction of rotation for the timespan D4.

Over the timespan D1, the engine is in engine-braking and no combustion is therefore initiated at the successive top dead centers of this timespan D1. During the timespan D2, the driver places demand on the engine to propel the vehicle and combustion is therefore activated normally (injections I1, I2, and I3) each time the piston passes through top dead center (TDC1, TDC2, TDC3) in this timespan D2.

The engine prediction means are activated at a first measurement predetermined angular position P1 before each top dead center so as to obtain a first prediction of the engine speed at a reference point. The reference point is preferably the next top dead center.

In the present example, this first measurement predetermined angular position P1 is set at an angle of 24° before top dead center. In the present example, the crankshaft 4 has an external toothset 6 comprising 60 teeth so that two adjacent teeth are angularly separated by 6 degrees. The sensor 7 identifying the angular position of the engine by detecting the teeth of the toothset 6, the angular position of 24° before top dead center corresponds to four teeth of the toothset 6 preceding top dead center. In a variant, the first measurement predetermined angular position P1 may be modified to suit a particular engine and/or according to the phasing of the toothset 6 with respect to top dead center and/or other types of means for determining the angular position of the engine.

The prediction means are activated at this first measurement predetermined angular position P1 and allow the future engine speed at top dead center to be estimated in advance. If the value of the predicted speed reflects a change in the direction of rotation of the engine around the top dead center concerned, engine protection means are implemented, such as inhibiting the combustion which ought normally to occur around about this top dead center. The combustion point is generally situated at an engine angular position comprised within a range extending from 10° before top dead center to 10° after top dead center.

When the first prediction of the engine speed is above a predetermined upper threshold S2, a reversal of the direction of rotation of the engine at the next top dead center is considered to be impossible and the commanding of the combustion operation scheduled to occur for this top dead center is maintained. This is the case for the combustions that occur at top dead centers TDC1, TDC2, TDC3.

In the example relating to FIG. 2, the first engine speed prediction made at the point P1, situated 24° before top dead center TDC1, results in a first prediction of the engine speed which equals 1200 rpm. Because this first prediction of the engine speed at top dead center TDC1 is very much higher than 400 rpm, the injection I1 triggering combustion at top dead center TDC1 does indeed occur.

Likewise, the first engine speed prediction made at the point P1 situated 24° before top dead center TDC2 results in a first prediction of the engine speed which equals 1400 rpm, and the injection I2 triggering combustion at top dead center TDC2 does indeed occur.

Likewise, the first engine speed prediction made at the point P1 situated 24° before top dead center TDC3 results in a first prediction of the engine speed which equals 600 rpm, and the injection I3 triggering combustion at top dead center TDC2 is likewise maintained.

As far as top dead center TDC4 is concerned, the prediction means are also activated when the engine is in the first measurement predetermined angular position P1, namely at TDC−24°. In this example, the first prediction of the engine speed at top dead center TDC4 is 330 rpm. This first prediction of the engine speed at top dead center TDC4 lies in the area of uncertainty comprised between the predetermined lower threshold S1 and the predetermined upper threshold S2. In this case, a second prediction of the engine speed at the same top dead center will be made later, when the engine reaches a second measurement predetermined angular position. In the present example, this second measurement predetermined angular position is set at an angle of 18° before the top dead center concerned. In this example, the engine moves on from the first measurement predetermined angular position P1 to the second measurement predetermined angular position P2 by a rotation through 6 degrees, which here corresponds to a rotation by one tooth on the external toothset 6 of the flywheel 5. The prediction means are therefore activated again at this second measurement predetermined angular position P2, namely at the angular position TDC−18°, so as to obtain a second prediction of the engine speed at the same top dead center TDC4. In this example, the second prediction results in a value of 93 rpm, which is below the predetermined lower threshold S1, and it is therefore proven that a reversal of the direction of rotation of the engine will occur.

In this case, the injection normally scheduled for top dead center TDC4 is inhibited, which is to say that the engine control unit 8 keeps the corresponding injector closed. In FIG. 2, no injection signal appears after injection I3 as the injection corresponding to top dead center TDC4 does not occur.

In the example of FIG. 2, the prediction at the angular position P2 is a closer reflection of reality than the prediction at the angular position P1, because the prediction at the position P2 takes account of the substantial drop in engine speed which occurs between the angular positions P1 and P2. The first prediction at the position P1 was unable to take account of the critical operation to which the engine is subjected here (a strong demand for torque with an inappropriate gear ratio engaged), whereas the prediction P2 has more information to take this situation into account. The piston 2 coming to a dead halt, which occurs on the curve portion 9, can be better anticipated in the second prediction than in the first prediction.

The method thus allows as many as are necessary successive predictions of engine speed to be made for as long as the prediction value remains in the area of uncertainty, gradually nearing the top dead center concerned, until a prediction value that is outside of the area of uncertainty is obtained. This last prediction, of which the value is either below the predetermined lower threshold S1, or above the predetermined upper threshold S2, allows a pronouncement as to whether a reversal of the direction of rotation of the engine will occur at the next top dead center to be made with certainty, so that the requisite measures (inhibiting or maintaining combustion at this top dead center) can be taken.

No combustion worsens the reversal of the direction of rotation of the engine that occurs over the timespan D3, and the engine therefore really reverts to its normal direction of rotation, over the timespan D4, without any damage to the engine and, particularly, to the dual mass flywheel 5. From the timespan D4 onward, the engine reverts to its normal operation.

Note that were a method of the prior art to be applied to the critical case illustrated in FIG. 2, with just one single prediction of the engine speed at top dead center and a threshold set at a commonly applied value of 300 rpm, the prediction of 330 rpm for top dead center TDC4 would lead to the conclusion that the engine will not experience a reversal of its direction of rotation and the combustion at top dead center TDC4 would be maintained, which would lead to the dual mass flywheel 5 becoming damaged or even destroyed.

Figure 3:
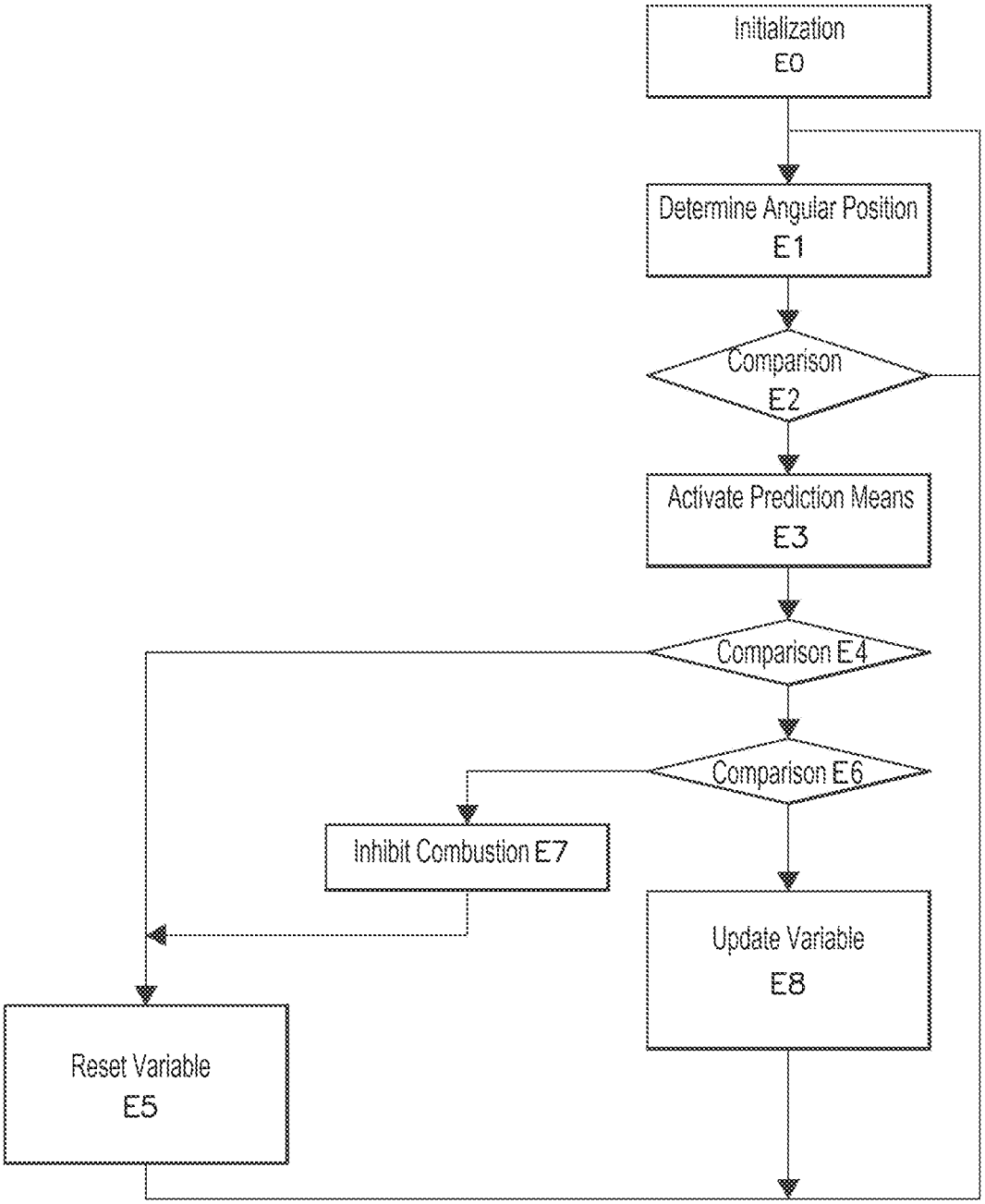
FIG. 3 is a diagram illustrating one embodiment of the method according to the invention.

FIG. 3 is a diagram illustrating one embodiment of the method according to the invention which has been implemented in the example of FIG. 2. This FIG. 3 illustrates the sequences that may be executed by the engine control unit 8 in order to implement the method according to an aspect of the invention.

The method involves first of all a first, initialization, step E0 which is performed as the system is switched on. During this initialization step E0, an angular-position variable for triggering prediction is initialized to, by way of value, the first measurement predetermined angular position P1. According to the example of FIG. 2, the angular-position variable for triggering prediction is therefore initialized to a value of TDC−24° (24° before top dead center).

The angular position of the engine is then measured (using the sensor 7 of FIG. 1) during a step E1.

During the next step E2, the angular position of the engine, captured in step E1, is compared against the angular-position variable for triggering prediction and, if it is different, the method loops back to step E1. When the angular position of the engine is equal to the angular-position variable for triggering prediction, which is to say, in this first pass after the initialization step E0, when the angular position of the engine corresponds to the first measurement predetermined angular position P1 equal to TDC−24°, the method moves on to a step E3 in which the prediction means are activated in order to obtain a protection of the engine speed at the next top dead center.

During a step E4, this prediction of the engine speed is compared against the predetermined upper threshold S2 (which in the example of FIG. 2 is 400 rpm) and, if it is above S2, the method moves on to a step E5 in which the value of the angular-position variable for triggering prediction is re-set to the first measurement predetermined angular position P1 (here TDC−24°) and, following step E5, the method loops back to step E1. In this case, engine operation has continued to proceed normally and the combustion scheduled for the top dead center concerned has indeed occurred. The method therefore resumes from step E1 for top dead center of the next cycle.

During step E4, if the prediction made at step E3 is below the predetermined upper threshold S2, the method moves on to a step E6 in which the engine speed prediction is compared against the predetermined lower threshold S1 (here 200 rpm) and, if it is below S1, the method moves on to a step E7 of commanding that the combustion at the top dead center concerned be inhibited. The injection and/or ignition scheduled for this top dead center therefore does not occur following the inhibition operation performed in step E7. This corresponds to instances in which a reversal of the direction of the engine is certain and in which inhibiting the corresponding combustion will allow the engine to be protected. Step E7 then loops back to step E5 to set the angular-position variable for triggering prediction back to the first predetermined angular position in order thereafter to resume the method from step E1 for the next cycle.

During step E6, if the engine speed prediction made in step E3 is above the predetermined lower threshold, that means that the prediction of step E3 has resulted in a value that lies in the area of uncertainty between the two thresholds S1, S2. In this case, the method moves on to a step E8 in which the angular-position variable for triggering prediction is updated. A new value is assigned to the angular-position variable for triggering prediction, incrementing it by a fixed amount. In the example of FIG. 2, the angular-position variable for triggering prediction, the initial value of which is TDC−24° (24° before top dead center), may be incremented by 6 degrees, namely by the angular value corresponding to moving on to the next tooth of the flywheel, so that the angular-position variable for triggering prediction now has as its value the second measurement predetermined angular position P2 which, in this instance, is TDC−18° (18° before top dead center). After step E8, the method loops back to step E1, and a second prediction of the engine speed at top dead center will then be made when the engine reaches the second measurement predetermined angular position P2.

For a top dead center concerned, the method will cycle through the steps E1, E2, E3, E4, E6 and E8, re-updating on each pass the value of the angular-position variable for triggering prediction and consequently making successive predictions of the engine speed at top dead center at angular positions which edge successively closer to top dead center. This cyclic pathway continues until a value for the angular-position variable for triggering prediction leads to a prediction of engine speed at top dead center that is outside the area of uncertainty and that consequently leads to the combustion at the top dead center concerned being maintained or inhibited. The method will then be repeated on approaching each top dead center.

Variant embodiments may be implemented without departing from the scope of the invention. In particular, the values for the first and second measurement predetermined angular positions P1, P2 may vary so that they can be suited to a particular type of engine. Likewise, the predetermined lower threshold S1 and the predetermined upper threshold S2 may vary to be suited to a particular engine using conservative values as explained above. An aspect of the invention may further employ any prediction means that enable, at a first angular position of the engine, the prediction of the engine speed for a future second angular position of the engine.

As a variant, the predetermined lower threshold S1 and the predetermined upper threshold S2 may differ, when evaluating a first prediction of the engine speed at top dead center (which prediction is made at the first measurement predetermined angular position P1) from those used for making a second prediction (at the second measurement predetermined angular position P2), or else when making an additional prediction at a subsequent angular position.

Furthermore, the example described in a simplified form hereinabove may be applied to any type of engine, irrespective of the number of cylinders it has.

The invention claimed is:

1. An engine control method for protecting an internal combustion engine during reverse rotation, the internal combustion engine comprising:

a sensor configured to determine the angular position of the engine, this angular position being defined as being the angular position of the crankshaft of the engine;

an engine control unit configured to predict, at a first angular position of the engine, the engine speed for a future second angular position of the engine;

the method comprises, for each cylinder of the engine:

when the engine reaches a first measurement predetermined angular position, obtaining a first prediction of the engine speed at the next top dead center;

when the first prediction of the engine speed is above a predetermined upper threshold, executing the next combustion for this cylinder of the engine, when the first prediction of the engine speed is below a predetermined lower threshold, inhibiting the next combustion for this cylinder of the engine; and when the first prediction of the engine speed is between the predetermined lower threshold and the predetermined upper threshold, and the engine reaches a second measurement predetermined angular position which is subsequent to the first measurement predetermined angular position, obtaining a second prediction of the engine speed at said next top dead center.

2. The method as claimed in claim 1, further comprising:

when a prediction of the engine speed is between the predetermined lower threshold and the predetermined upper threshold, and the engine reaches a measurement predetermined angular position which is subsequent to the second measurement predetermined angular position, obtaining an additional prediction of the engine speed at said next top dead center.

3. The method as claimed in claim 1, wherein the predetermined level threshold has a value comprised between 150 and 250 rpm.

4. The method as claimed in claim 1, wherein the predetermined upper threshold has a value comprised between 350 and 450 rpm.

5. The method as claimed in claim 1, wherein the first measurement predetermined angular position has a value comprised between 18° and 30° before top dead center.

6. The method as claimed in claim 1, wherein the second measurement predetermined angular position has a value comprised between 12° and 24° before top dead center.

7. The method as claimed in claim 1, wherein the internal combustion engine comprises a flywheel equipped with a circumferential toothset, and the sensor faces the circumferential toothset, in which method a step of detecting the first measurement predetermined angular position is performed by detecting a first predetermined tooth of the flywheel.

8. The method as claimed in claim 7, wherein the second measurement predetermined angular position corresponds to an angular position in which the sensor detects a second predetermined tooth of the flywheel, this second predetermined tooth immediately following the first predetermined tooth.

9. The method as claimed in claim 1, wherein the operation of inhibiting the next combustion for this cylinder of the engine consists in inhibiting the next injection of fuel and/or the next ignition operation for this cylinder of the engine.

10. The method as claimed in claim 1, wherein obtaining the first prediction of the engine speed at the next top dead center, and obtaining the second prediction of the engine speed at said next top dead center, comprise:

initializing an angular-position variable for triggering prediction at the first measurement predetermined angular position; and if a prediction of the engine speed is comprised between the predetermined lower threshold and the predetermined upper threshold, updating the angular-position variable for triggering prediction to a value corresponding to an angular position subsequent to the first measurement predetermined angular position.

11. The method as claimed in claim 10, further comprising:

making a prediction of the engine speed at said next top dead center when the angular position of the engine corresponds to the angular-position variable for triggering prediction.

12. An engine control unit connected to a sensor for determining an angular position of an engine and configured for inhibiting or executing combustion in a cylinder of the engine by exercising control over an injection of fuel and/or ignition by a spark plug, the engine control unit configured to perform each of the steps of the method as claimed in claim 1.

* * * * *